US011267246B2

(12) United States Patent
Achi

(10) Patent No.: US 11,267,246 B2
(45) Date of Patent: Mar. 8, 2022

(54) COATING APPARATUS AND IMAGE FORMING SYSTEM INCLUDING SAME

(71) Applicant: Keita Achi, Kanagawa (JP)

(72) Inventor: Keita Achi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 145 days.

(21) Appl. No.: 16/846,659

(22) Filed: Apr. 13, 2020

(65) Prior Publication Data

US 2020/0324548 A1 Oct. 15, 2020

(30) Foreign Application Priority Data

Apr. 15, 2019 (JP) ..... JP2019-076840
Mar. 27, 2020 (JP) ..... JP2020-057288

(51) Int. Cl.
*B41J 2/16* (2006.01)
*B41J 11/00* (2006.01)

(52) U.S. Cl.
CPC ..... *B41J 2/1606* (2013.01); *B41J 11/0015* (2013.01)

(58) Field of Classification Search
CPC ..... B41J 2/1606; B41J 11/0015
See application file for complete search history.

(56) References Cited

U.S. PATENT DOCUMENTS

| | | | | |
|---|---|---|---|---|
| 2012/0229580 | A1 | 9/2012 | Ohba | |
| 2013/0106946 | A1 | 5/2013 | Sunaoshi | |
| 2021/0165349 | A1* | 6/2021 | Watanabe | G03G 15/2053 |
| 2021/0223722 | A1* | 7/2021 | Yamashita | G03G 15/2017 |

FOREIGN PATENT DOCUMENTS

| | | |
|---|---|---|
| JP | 2008-096557 | 4/2008 |
| JP | 2012-196955 | 10/2012 |
| JP | 2013-091260 | 5/2013 |

* cited by examiner

*Primary Examiner* — Lamson D Nguyen
(74) *Attorney, Agent, or Firm* — Harness, Dickey & Pierce, P.L.C.

(57) ABSTRACT

A coating apparatus includes a coating rotator, a pressure rotator, and a restrictor. The coating rotator is configured to coat a sheet with a coating liquid. The pressure rotator is configured to form a nip between the coating rotator and the pressure rotator. The restrictor is configured to directly or indirectly contact the pressure rotator when the sheet enters the nip, and restrict movement of the pressure rotator in a separating direction with respect to the coating rotator.

13 Claims, 9 Drawing Sheets

COATING APPARATUS AND IMAGE FORMING SYSTEM INCLUDING SAME

CROSS-REFERENCE TO RELATED APPLICATIONS

This patent application is based on and claims priority pursuant to 35 U.S.C. § 119(a) to Japanese Patent Application Nos. 2019-076840, filed on Apr. 15, 2019, and 2020-057288, filed on Mar. 27, 2020, in the Japan Patent Office, the entire disclosure of each of which is incorporated by reference herein.

BACKGROUND

Technical Field

Aspects of the present disclosure relate to a coating apparatus to coat a coating liquid to a sheet, such as a sheet of paper, and an image forming system including the coating apparatus.

Related Art

As an example of an image forming system including an image forming apparatus such as an inkjet printer, there is known an image forming system including a coating apparatus that coats a sheet such as a sheet of paper with a coating liquid.

For example, a coating apparatus is installed upstream form an image forming apparatus (inkjet printer) and coats a surface of a sheet (recording medium) conveyed to the inkjet printer with a coating liquid (treatment liquid) such as a bleeding inhibitor. Accordingly, image failures such as bleeding are less likely to occur in an image formed on a sheet in the image forming apparatus.

SUMMARY

In an aspect of the present disclosure, there is provided a coating apparatus that includes a coating rotator, a pressure rotator, and a restrictor. The coating rotator is configured to coat a sheet with a coating liquid. The pressure rotator is configured to form a nip between the coating rotator and the pressure rotator. The restrictor is configured to directly or indirectly contact the pressure rotator when the sheet enters the nip, and restrict movement of the pressure rotator in a separating direction with respect to the coating rotator.

In another aspect of the present disclosure, there is provided an image forming system that includes the coating apparatus and an image forming apparatus.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
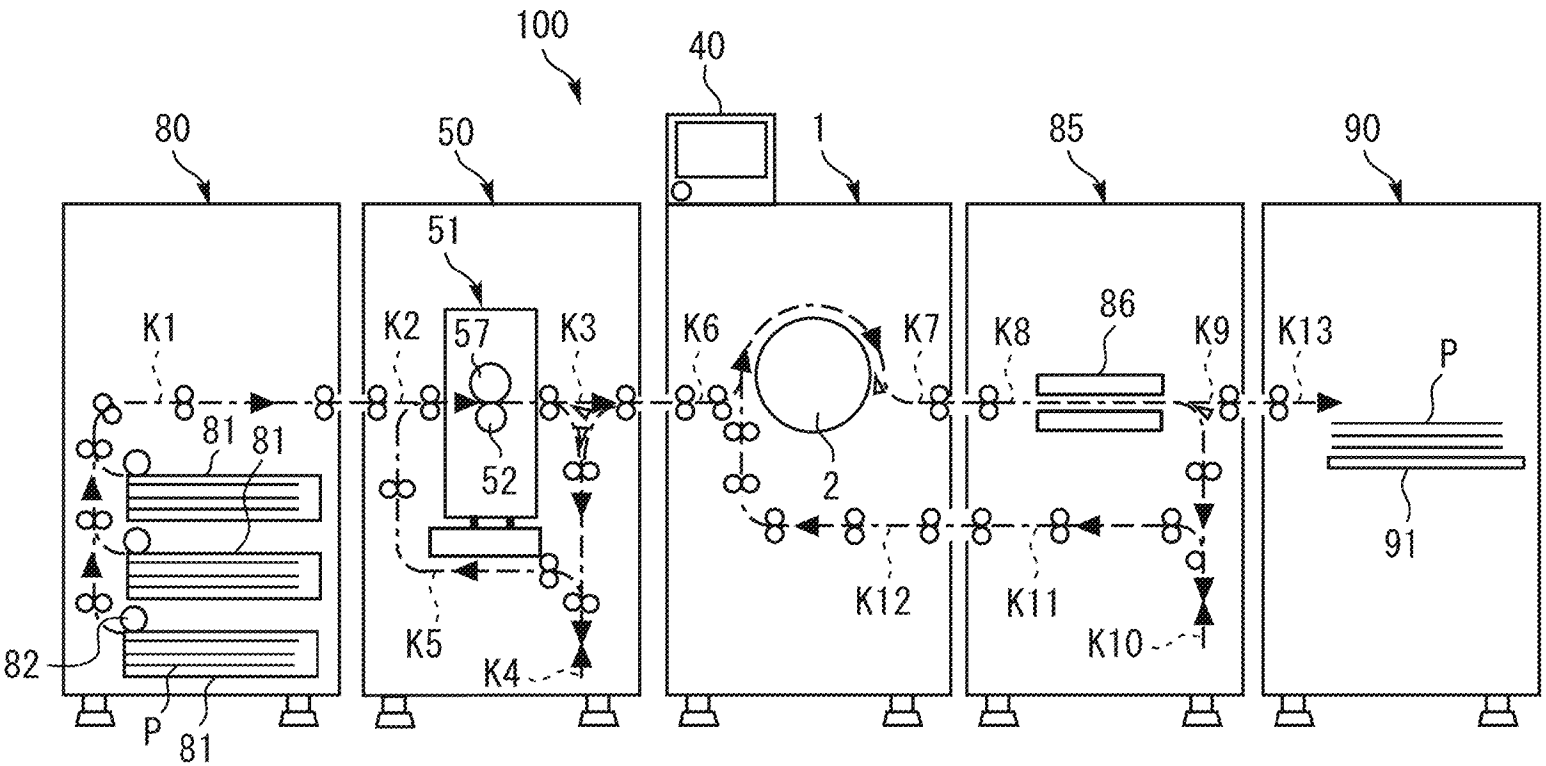
FIG. 1 is an overall view of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Next, a description is given of embodiments of the present disclosure, with reference to drawings. Note that identical parts are given identical reference numerals and redundant descriptions are summarized or omitted accordingly.

First, an overall configuration and operation of an image forming system 100 are described with reference to FIG. 1. In FIG. 1, the image forming system 100 according to an embodiment of the present disclosure includes an image forming apparatus 1, a coating apparatus 50, a sheet feeding apparatus 80, a drying apparatus 85, and a sheet ejecting apparatus 90. The image forming apparatus 1 illustrated as inkjet printer forms an image on a sheet P. The coating apparatus 50 coats a coating liquid as a pretreatment to the sheet P conveyed to the image forming apparatus 1. The drying apparatus 85 dries ink on the sheet P after image formation. The sheet ejecting apparatus 90 stacks sheets P ejected from the drying apparatus 85. As illustrated in FIG. 1, in the image forming system 100 according to the present embodiment, the sheet feeding apparatus 80, the coating apparatus 50, the image forming apparatus 1, the drying apparatus 85, and the sheet ejecting apparatus 90 are connected in turn from an upstream side in a direction of conveyance of the sheet P.

The operation of the image forming system 100 is briefly described with reference to FIG. 1. First, when a print command is input together with image information from, e.g., a personal computer to a controller of the image forming system 100, the sheet P is fed from a sheet feed cassette 81 by a sheet feeding roller 82. The sheet P fed from the sheet feed cassette 81 is conveyed by conveyance rollers to the coating apparatus 50 via a first conveyance passage K1. In the present embodiment, the sheet feeding apparatus 80 feeds cut sheets stored in the sheet feed cassette 81. In some embodiment, the sheet feeding apparatus 80 may feed a roll sheet of paper.

Thereafter, the sheet P conveyed to the coating apparatus 50 is conveyed to a coating-apparatus main unit 51 via a second conveyance passage K2. In the coating-apparatus main unit 51, a lower surface of the sheet P (a sheet surface that becomes a front surface at the time of image formation) is coated with a coating liquid (pretreatment liquid) for reducing, e.g., bleeding and show-through. The sheet P coated with the coating is conveyed to a reversing passage K4 (fourth conveyance passage) and the conveyance direction of the sheet P is reversed. In the sate in which the sheet P is reversed (the sheet surface coated with the coating liquid is the front surface (the upper surface), the sheet P is conveyed to the image forming apparatus 1 via the third conveyance passage. Here, when a mode (duplex print mode) in which image formation is performed on both sides of the sheet P is selected by the image forming apparatus 1, both sides of the sheet P are coated with the coating liquid. Therefore, after one side of the sheet P is coated with the coating liquid, the sheet P is conveyed to the reversing passage K4, the conveyance direction of the sheet P is reversed and both sides of the sheet P are reversed. Then, the sheet P is conveyed to a duplex passage K5 (fifth conveyance passage) and conveyed to the coating-apparatus main unit 51 again. After the other side of the sheet P is coated with the coating liquid in the coating-apparatus main unit 51, the sheet P is conveyed to the image forming apparatus 1 via the third conveyance passage K3 with the other side facing up. The configuration and operation of the coating-apparatus main unit 51 in the coating apparatus 50 are further described later with reference to FIG. 3.

The sheet P conveyed to the image forming apparatus 1 passes through a sixth conveyance passage K6 and is fed to a conveyance drum 2. While being conveyed by the conveyance drum 2, a desired image is formed on the front surface (upper surface). The front surface of the sheet P has been coated with the coating liquid by the pre-treatment, thus restraining blurring or show-through of the image. The sheet P on which the image has been formed is conveyed to the drying apparatus 85 via a seventh conveyance passage K7. The configuration and operation of the image forming apparatus 1 is further described later with reference to FIG. 2.

The sheet P conveyed to the drying apparatus 85 is conveyed to a dryer unit 86 after passing through an eighth conveyance passage K8, and the image on the sheet P is dried by the dryer unit 86. The sheet P on which the image has been dried is conveyed to the sheet ejecting apparatus 90 via a ninth conveyance passage K9. Here, when the above-described duplex print mode is selected, images are formed on both sides of the sheet P. Therefore, after the image on one side of the sheet P is dried, the sheet P is conveyed to a reversing passage K10 (tenth conveyance passage) and the conveyance direction of the sheet P is reversed. After both sides of the sheet P are reversed, the sheet P is conveyed to duplex passages K11 and K12 (eleventh and twelfth conveyance passages) and is conveyed again to the conveyance drum 2 of the image forming apparatus 1. After the desired image has been formed on the other side of the sheet P on the conveyance drum 2, the sheet P is conveyed again to the drying apparatus 85 via the seventh conveyance passage K7. After the image on the other side of the sheet P has been dried by the dryer unit 86, the sheet P with the other side facing up is conveyed to the sheet ejecting apparatus 90 via the ninth conveying path K9.

The sheet P conveyed to the sheet ejecting apparatus 90 passes through a thirteenth conveyance passage K13 and is stacked on a sheet ejection tray 91. Thus, a series of operations in the image forming system 100 is completed.

Figure 2:
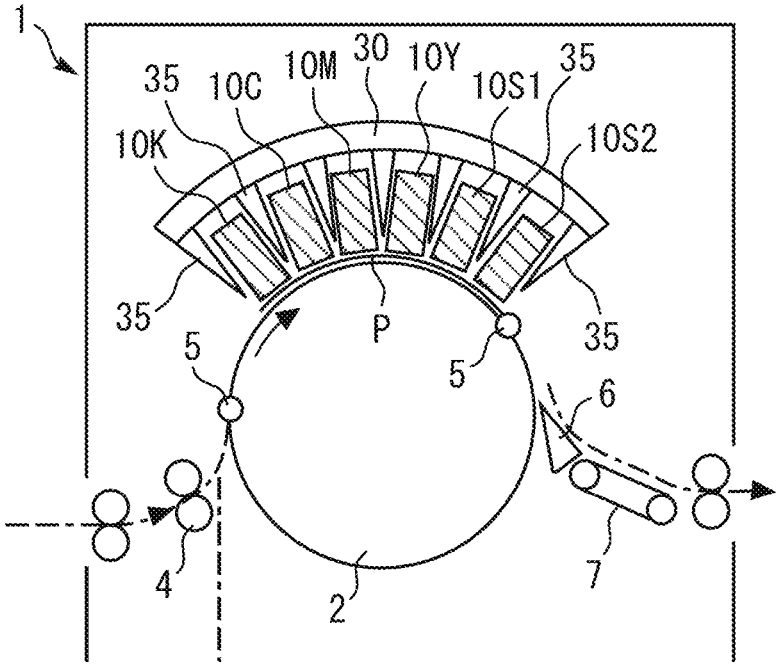
FIG. 2 is a schematic view of a configuration of a part of the image forming apparatus.

Hereinafter, the image forming apparatus 1 (inkjet printer) is described in detail with reference to FIG. 2. In FIG. 2, the image forming apparatus 1 includes the conveyance drum 2, clippers 5, a separator 6, and a conveyance belt 7. The conveyance drum 2 conveys the sheet P. The clippers 5 hold the sheet P on the conveyance drum 2. The separator 6 separates the sheet P from the conveyance drum 2. The conveyance belt 7 conveys the sheet P separated from the conveyance drum 2. The image forming apparatus 1 further includes heads 10Y, 10M, 10C, 10K, 10S1, and 10S2, a base frame 30, and beam members 35. For the heads 10Y, 10M, 10C, 10K, 10S1, and 10S2, image forming devices to print, e.g., characters or images by an inkjet method are unitized as printing modules. The base frame 30 holds the beam members 35.

Here, as illustrated in FIG. 2, the image forming apparatus 1 according to the present embodiment forms a color image, and includes the head 10K for black, the heads 10Y, 10M, and 10C for three colors (yellow, magenta, cyan), and the two heads 10S1 and 10S2 for coating (special color). The six heads 10Y, 10M, 10C, 10K, 10S1, and 10S2 face the conveyance drum 2 with minute gaps and are arranged side by side radially along a direction of rotation of the conveyance drum 2. The six heads 10Y, 10M, 10C, 10K, 10S1, and 10S2 have substantially the same structure except that the colors (types) of inks used for printing are different. Each of the heads 10Y, 10M, 10C, 10K, 10S1, and 10S2 is a substantially rectangular parallelepiped unit. Each head includes a piezoelectric actuator as a main part and further includes, e.g., nozzles to discharge ink as liquid (droplets), an ink tank filled with ink, and a control board (controller).

An operation of the image forming apparatus 1 is briefly described with reference to FIG. 2. When a sheet P is fed into the image forming apparatus 1, the sheet P is conveyed toward the conveyance drum 2 by the conveyance rollers 4. On the other hand, in the heads 10Y, 10M, 10C, 10K, 10S1, and 10S2 of the respective colors, input image data are converted into writing data of the respective colors. The sheet P conveyed to the conveyance drum 2 is positioned on the conveyance drum 2 in a state of being held by the clippers 5, and is conveyed along the counterclockwise rotation of the conveyance drum 2. On the sheet P conveyed in a direction indicated by an arrow in FIG. 2 by the rotation of the conveyance drum 2, inks of the respective colors as liquids are sequentially discharged from the heads 10Y, 10M, 10C, 10K, 10S1, and 10S2 based on the writing data. Thus, a desired image is formed on the sheet P. The sheet P, on which the desired image has been formed, is separated from the conveyance drum 2 by the separator 6. The sheet P separated from the conveyance drum 2 is conveyed by the conveyance belt 7 and further conveyed toward the drying apparatus 85 by conveyance rollers.

Hereinafter, with reference to FIGS. 3A and 3B, the coating apparatus 50 in the image forming system 100 according to the present embodiment is further described. The coating apparatus 50 is an apparatus to coat a sheet P, such as a sheet of paper, with coating liquid G. As illustrated in FIG. 3, the coating apparatus 50 (coating-apparatus main unit 51) according to the present embodiment includes a coating roller 52 as a coating rotator, an intermediate roller 53, a draw-up roller 54, a pressure roller 57 as a pressure rotator, a reservoir 55, pressing mechanisms (including pressing arms 58, pressing cams 59, and tension springs 60), and stoppers 66 as restrictors.

The coating roller 52 as a coating rotator is a roller to apply the coating liquid G to the sheet P and is arranged to extend in a longitudinal direction of the coating roller 52 (a direction perpendicular to the surface of the drawing of FIG. 3, that is, a rotation axis direction of the coating roller 52). The pressure roller 57 as a pressure rotator is a roller that forms a nip with the coating roller 52 in a longitudinal direction of the pressure roller 57 and is held by a main unit housing of the coating apparatus 50 so as to be movable up and down. The intermediate roller 53 is a roller that contacts the coating roller 52 and the draw-up roller 54. The reservoir 55 stores a certain amount of the coating liquid G. The reservoir 55 is a substantially rectangular box-shaped member whose longitudinal direction is perpendicular to the surface of the drawing of FIG. 3. The draw-up roller 54 is a draw-up member to draw up the coating liquid G stored in the reservoir 55.

The draw-up roller 54 carries the coating liquid G from the reservoir 55 while rotating in a clockwise direction in FIG. 3. The coating liquid G carried by the draw-up roller 54 is transferred to and carried by the intermediate roller 53 (metering roller) rotating in a counterclockwise direction in FIG. 3. The coating liquid G carried on the intermediate roller 53 is adjusted (measured) to an appropriate amount at a contact position with the coating roller 52 rotating in the clockwise direction in FIG. 3. Thus, the adjusted coating liquid G is carried on the coating roller 52. The coating liquid G carried on the coating roller 52 is applied to a sheet surface (lower surface) of the sheet P conveyed to the nip between the coating roller 52 and the pressure roller 57 (coating step). In the coating step, the pressure roller 57 is rotated in the counterclockwise direction in FIG. 3 while axial end portions of a rotation shaft of the pressure roller 57 are pressed by the pressing arms 58 of the pressing mechanisms (including the pressing arms 58, the pressing cams 59, and the tension springs 60).

The draw-up roller 54 is connected to a drive motor 72 and is rotated in a predetermined direction by the drive motor 72 controlled by the controller. The intermediate roller 53 and the coating roller 52 are driven by the drive motor 72 via a gear train and rotate in respective predetermined directions. The pressure roller 57 is provided with a gear to contact and separate from the gear train at a shaft end portion of the pressure roller 57. A driving force of the drive motor 72 is transmitted to the gear to rotate the pressure roller 57.

The pressure roller 57 is movable in contact and separating directions (vertical direction) with respect to the coating roller 52 by the pressing mechanisms (including the pressing arms 58, the pressing cams 59, and the tension springs 60). Each of the pressing mechanisms includes the pressing arm 58, the pressing cam 59, and the tension spring 60. Each of the pressing arms 58 is held by the main unit housing of the coating apparatus 50 so as to be rotatable about a support shaft 58*a* and urges the pressure roller 57 toward the coating roller 52. One end of the tension spring 60 is connected to the pressing arm 58, and the other end of the tension spring 60 is connected to the movable plate 69. A movable plate 69 is moved up and down by the pressing cam 59 that is rotated by the cam motor 71. When the coating step is performed, the pressure roller 57 is moved to the contact position illustrated in FIG. 3A, at which the pressure roller 57 contacts the coating roller 52, by the pressing mechanisms (including the pressing arms 58, the pressing cams 59, and the tension springs 60). When the coating step is not performed, the pressure roller 57 is moved to a separated position (a position at which the pressure roller 57 is separated from the coating roller 52) by the pressing mechanisms (including the pressing arms 58, the pressing cams 59, and the tension springs 60).

Here, the coating apparatus 50 according to the present embodiment includes the stopper 66 as a restrictor that indirectly contacts the pressure roller 57 when the sheet P enters the nip between the coating roller 52 and the pressure roller 57 and restricts the movement of the pressure roller 57 in the separating direction with respect to the coating roller 52. More specifically, when the sheet P enters the nip, the stopper 66 (restrictor) contacts the pressing arm 58 as illustrated in FIG. 3B to restrict the pressure roller 57 from moving in the separating direction (upward). That is, the upper limit of the moving amount of the pressure roller 57 in the separating direction (upward direction) is determined by the position at which the stopper 66 contacts the pressing arm 58.

Figure 3A:
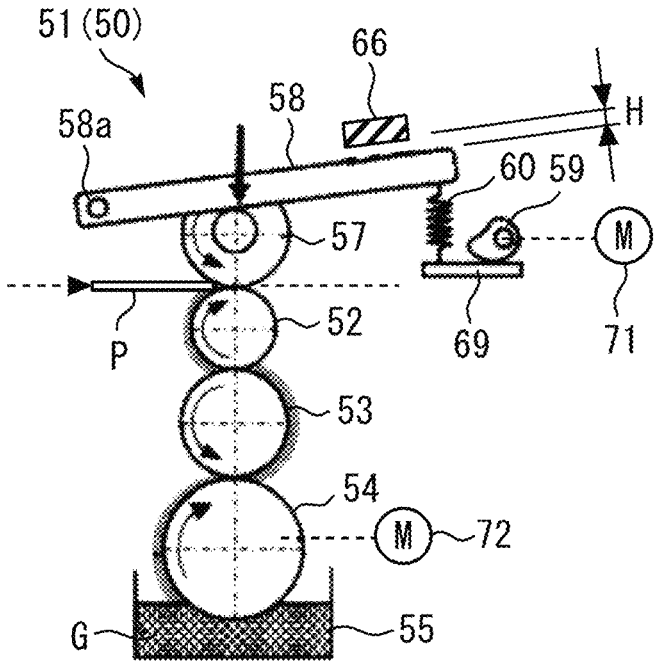
FIGS. 3A and 3B are schematic views of an operation of a part of a coating apparatus of the image forming system.

For example, as illustrated in FIG. 3A, the pressure roller 57 is in contact with the coating roller 52 until immediately before the sheet P enters the nip between the coating roller 52 and the pressure roller 57. In such a state, the stopper 66 is not in contact with the pressing arm 58, and a gap H is present between the pressing arm 58 and the stopper 66. Then, as illustrated in FIG. 3B, at the moment when a leading edge of the sheet P enters the nip between the coating roller 52 and the pressure roller 57, the pressure roller 57 is forcefully pushed up by the sheet thickness (the thickness of the sheet P). However, since the pressing arm 58 comes into contact with the stopper 66, the push-up is minimized.

As described above, the stopper 66 (restrictor) can reduce a phenomenon in which the pressure roller 57 would jump up to the thickness of the sheet P or more at the moment when the sheet P enters the nip between the coating roller 52 and the pressure roller 57. Thus, the stopper 66 can reduce a failure that the amount of the coating liquid applied to the sheet P by the coating roller 52 may vary (uneven coating).

As described above, in a state where the sheet P does not enter the nip, a predetermined gap H is provided between the stopper 66 and the pressing arm 58. That is, in a state where the sheet P does not enter the nip, the stopper 66 does not directly or indirectly contact the pressure roller 57 in the state where the sheet P does not enter the nip between the coating roller 52 and the pressure roller 57. In the present embodiment, the size of the predetermined gap H is set such that the stopper 66 and the pressing arm 58 do not contact each other when the sheet P passes through the nip in a case where the thickness of the sheet P is less than a predetermined thickness and such that the stopper 66 and the pressing arm 58 contact each other when the sheet P passes through the nip in a case where the thickness of the sheet P is equal to or greater than the predetermined thickness. Accordingly, when a sheet P having a thickness less than a predetermined thickness, such as a thin sheet of paper, passes through the nip, the above-described configuration can prevent the load of the motor that drives the roller pair (the coating roller 52 and the pressure roller 57) from increasing, and restrain a failure in which the load of the stopper 66 might disturb the conveyance of the sheet P (thin paper) having low stiffness to cause, e.g., wrinkles of the sheet P. On the other hand, when a sheet P having a thickness equal to or greater than a predetermined thickness, such as a thick sheet of paper, passes through the nip, the above-described configuration can reduce the phenomenon in which the pressure roller 57 jumps up to a thickness equal to or greater than the thickness of the sheet P.

Figure 4A:
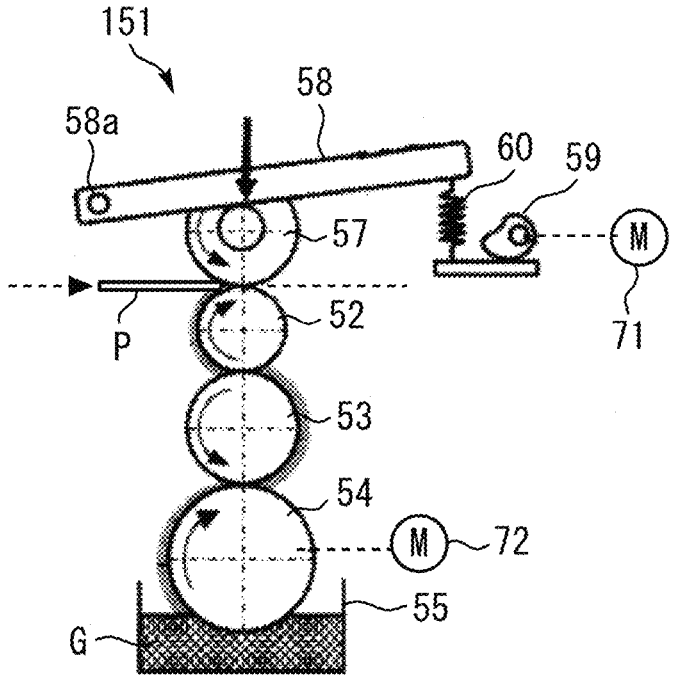
FIGS. 4A and 4B are schematic views of an operation of an operation of a part of a coating apparatus according to a comparative example.
Figure 4B:
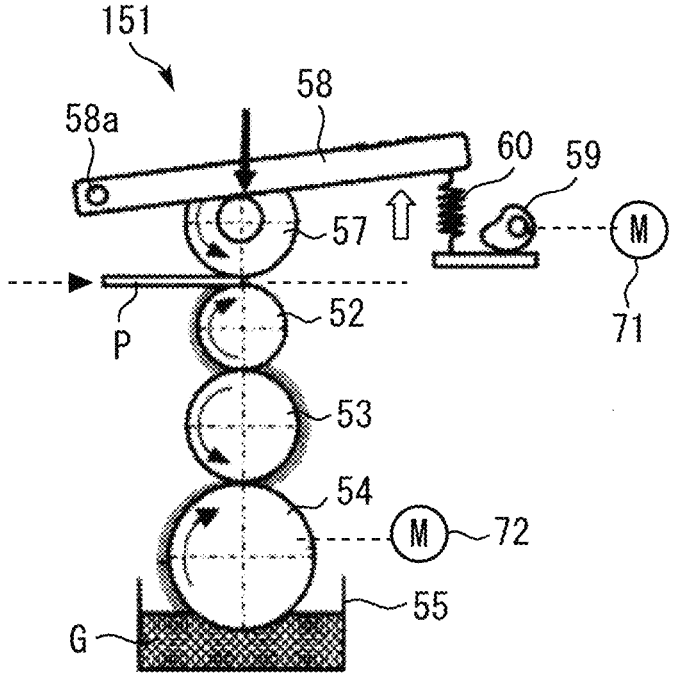

More specifically, in the case where the stopper 66 (restrictor) is not provided as in a coating apparatus 151 illustrated in FIGS. 4A and 4B, the pressure roller 57 jumps up more than the thickness of the sheet P at the moment when the sheet P enters the nip between the coating roller 52 and the pressure roller 57 as illustrated in FIGS. 4A and 4B. At the moment when the pressure roller 57 jumps up, the pressure applied to the coating roller 52 is weakened and the coating roller 52 (or the intermediate roller 53) is displaced upward. Accordingly, a large amount of the coating liquid G passes through the nip between the coating roller 52 and the intermediate roller 53 (or the nip between the intermediate roller 53 and the draw-up roller 54), which causes shortage of the transfer amount of the coating liquid G. Consequently, the amount of the coating liquid G applied to the sheet P by the coating roller 52 varies at the nip. In particular, when the conveyance speed of the sheet P is high or the thickness of the sheet P is large, such a failure may become remarkable. In order to solve such a failure, for example, a method of increasing the spring constant of the tension spring 60 to increase the pressing force of the pressure roller 57 or a method of fixing the pressure roller 57 so as not to move up and down is conceivable. However, the former method is likely to cause a conveyance failure due to a delay of the sheet P entering the nip (a delay in conveyance timing) and the latter method is likely to cause a conveyance failure that the sheet P does not pass the nip.

By contrast, in the present embodiment, since the movement of the pressure roller 57 in the separating direction is allowed to some extent and the moving amount of the pressure roller 57 is restricted, the occurrence of failures as described above can be reduced. That is, it is possible to reduce the uneven coating (coating variation) of the coating liquid G applied to the sheet P without causing the conveyance failure of the sheet P.

In the present embodiment, the stopper 66 (restrictor) is provided that can indirectly contact the pressure roller 57 via the pressing arm 58 when the sheet P enters the nip between the coating roller 52 and the pressure roller 57. In other words, the stopper 66 contacts the pressing arm 58 as a member movable in conjunction with the pressure roller 57 to indirectly contact the pressure roller 57. In some embodiments, the stopper 66 (restrictor) may directly contact the pressure roller 57 when the sheet P enters the nip between the coating roller 52 and the pressure roller 57. That is, the stopper 66 may contact a portion of a surface of the pressure roller 57 outside a region through which the sheet P passes or may contact a rotation shaft of the pressure roller 57.

In the present embodiment, the coating roller 52 is displaceable in the vertical direction. However, in some embodiments, the coating roller 52 may be secured so as not to be displaceable in the vertical direction. Such a configuration can also prevent the pressure roller 57 from jumping up more than the thickness of the sheet P. Accordingly, the width of the nip between the pressure roller 57 and the coating roller 52 can be restrained from changing at the moment when the sheet P enters, thus restraining the coating amount of the coating liquid from varying between a leading end portion of the sheet P and the other portions.

In the present embodiment, the stopper 66 as the restrictor is formed of a rubber material as an elastic material. The position of the stopper 66 (the gap H between the stopper 66 and the pressing arm 58) is set in accordance with the thickness of a sheet P of a frequently used type (for example, plain paper). That is, when the sheet P is not conveyed to the nip, as illustrated in FIG. 3A, there is the gap H between the stopper 66 and the pressing arm 58. The stopper 66 is set so as to just contact the pressing arm 58 in a state where the sheet P of the frequently used type enters the nip and the pressure roller 57 (pressing arm 58) is lifted against the urging of the tension spring 60 by the thickness of the sheet P. However, in such a case, if a thick sheet P thicker than the sheet P of the frequently used type is conveyed, the thick sheet P may not smoothly pass through the nip. Therefore, in the present embodiment, the stopper 66 is formed of a rubber material. When the thick sheet P enters the nip, the stopper 66 contacts the pressing arm 58 in a state of being elastically deformed with good responsiveness, thus preventing the conveyance failure of the sheet P. In particular, in the present embodiment, urethane rubber having a Shore A hardness in the range of 30 to 70 is used as the rubber material of the stopper 66 (restrictor). As a result of repeated studies, the inventor of the present application has found that the stopper 66 forming of such a material facilitates exertion of the above-described effect. In the present embodiment, a member such as a plate spring may be used as the elastic material instead of the rubber material.

Variation 1

Figure 3B:
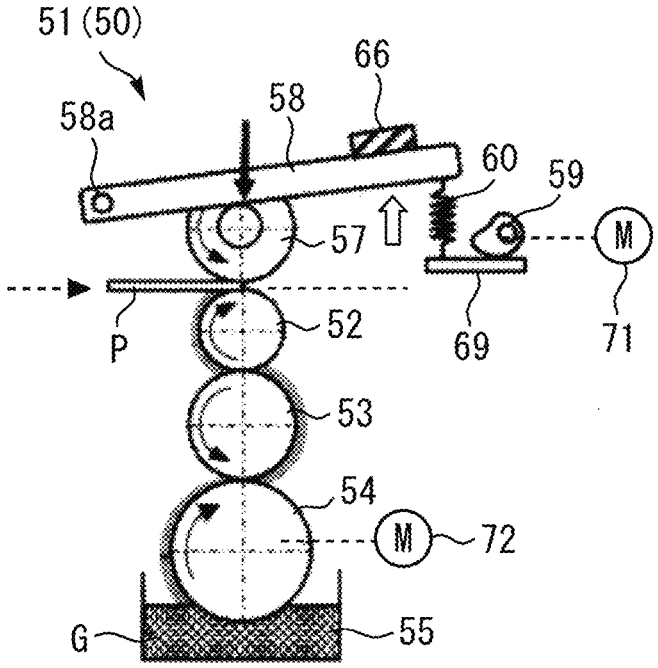
Figure 5:
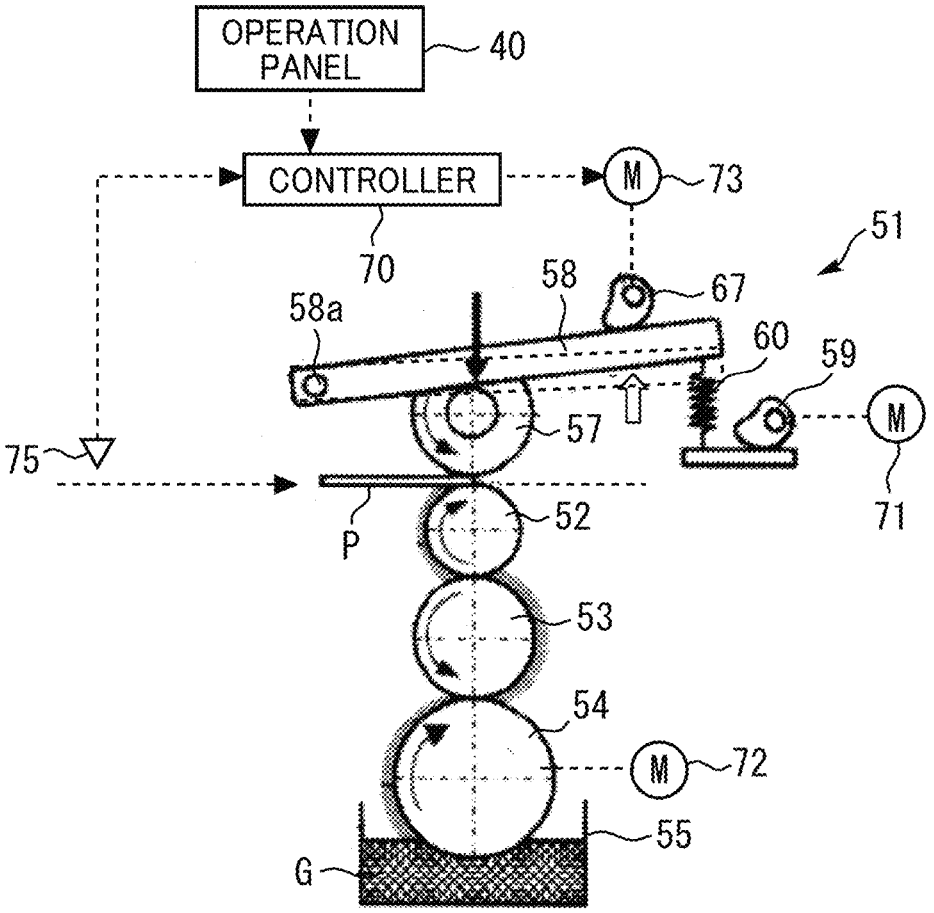
FIG. 5 is a schematic view of a part of a coating apparatus according to Variation 1.

FIG. 5 is a view of a main unit (coating-apparatus main unit 51) of a coating apparatus 50 as Variation 1 and is a view corresponding to FIG. 3B in the present embodiment. As illustrated in FIG. 5, in Variation 1, a cam 67 as an adjustment mechanism is used as the restrictor instead of the stopper 66 in the present embodiment. The cam 67 as the restrictor is a cam capable of adjusting the movable distance of the pressure roller 57 in the separating direction (upward direction) according to the thickness (sheet thickness) of the sheet P entering the nip between the coating roller 52 and the pressure roller 57. For example, the cam 67 (restrictor) as the adjustment mechanism is installed such that a cam surface of the cam 67 can contact an upper portion of the pressing arm 58, thus restricting the movement of the pressing arm 58 in the separating direction (upward direction). A rotation shaft of the cam 67 (restrictor) is connected to a second cam motor 73. A controller 70 controls the second cam motor 73 to change the cam angle (posture in a direction of rotation of the cam 67). When the sheet P is not conveyed to the nip, there is a gap between the cam 67 and the pressure arm 58 (located at a rotation position indicated by a broken line in FIG. 5). When the sheet P enters the nip and lifts the pressure roller 57 (pressing arm 58) against the urging force of the tension spring 60 by the thickness of the sheet P, the cam 67 just contacts the pressing arm 58 (the state illustrated in FIG. 5). The cam angle of the cam 67 is adjusted according to the thickness of the sheet P entering the nip. That is, the gap between the cam 67 and the pressing arm 58 when the sheet P is not conveyed to the nip is adjusted. Specifically, the second cam motor 73 is controlled such that, when the thickness of the sheet P is large, the above-described gap becomes larger than when the thickness of the sheet P is small. Such a configuration can reduce the uneven coating (variation) of the coating liquid G applied to the sheet P without causing the conveyance failure of the sheet P regardless of the thickness of the sheet P.

In particular, in Variation 1, as illustrated in FIG. 5, a sheet-thickness detection sensor 75 as a detector that directly detects the thickness of the sheet P entering the nip is provided upstream from the nip in the sheet conveyance passage. As the sheet-thickness detection sensor 75, for example, a distance measurement sensor can be used. When the thickness of the sheet P detected by the sheet-thickness detection sensor 75 (detector) is large, the cam angle of the cam 67 is adjusted so that the movable distance of the pressure roller 57 in the separating direction is larger (the gap between the cam 67 and the pressing arm 58 during non-conveyance is larger) than when the thickness of the sheet P is small. The detector may indirectly detect the thickness of the sheet P entering the nip. For example, an operation display panel (operation panel) 40 (see FIG. 1) installed in an exterior portion of the image forming system 100 can be used as the detector. Specifically, the thickness of the sheet P entering the nip can be indirectly detected from the information on the sheet P input from the operation display panel 40 by the user. Further, as the adjustment mechanism, a contact member capable of contacting the pressing arm 58 and a member such as a solenoid that moves the contact member to change the gap between the pressing arm 58 and the contact member may be provided instead of the cam 67.

Variation 2

Figure 6A:
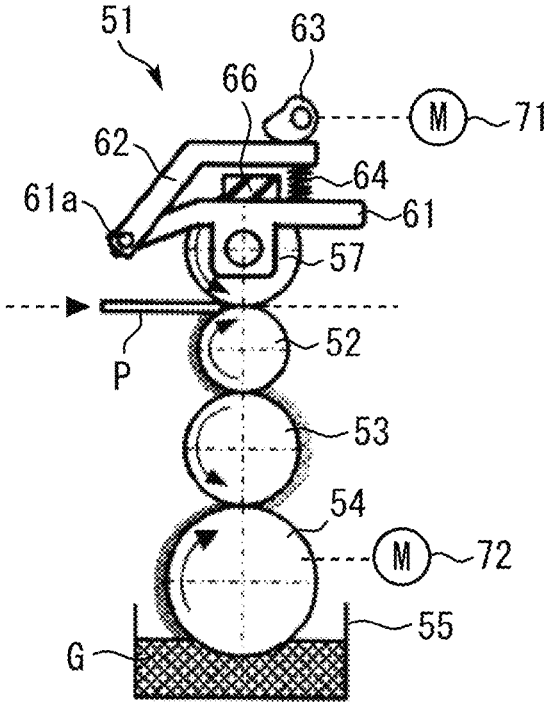
FIGS. 6A and 6B are schematic views of an operation of a part of a coating apparatus according to Variation 2.
Figure 6B:
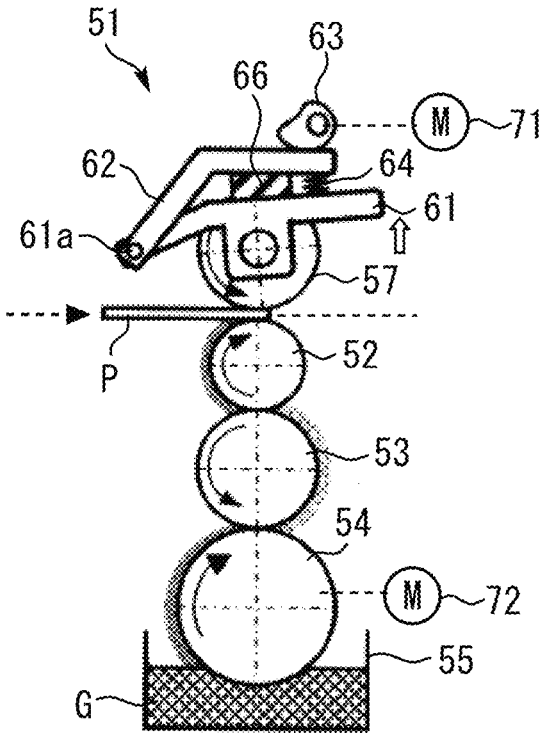

FIGS. 6A and 6B are views of a main part (coating-apparatus main unit 51) of a coating apparatus 50 as Variation 2 and correspond to FIGS. 3A and 3B in the present embodiment. The coating apparatus 50 in Variation 2 is different from the coating apparatus 50 of the present embodiment in the configuration of pressing mechanisms (including first pressing arms 61, second pressing arms 62, pressing cams 63, and compression springs 64) that press the pressure roller 57 against the coating roller 52. As illustrated in FIG. 6, each pressing mechanism in Variation 2 includes, e.g., the first pressing arm 61, the second pressing arm 62, the pressing cam 63, and the compression spring 64. The first pressing arm 61 is held by a main unit housing of the coating apparatus 50 so as to be rotatable about a support shaft 61*a* of the first pressing arm 61. The first pressing arm 61 rotatably holds the pressure roller 57. The second pressing arm 62 is held by the main unit housing so as to be rotatable about the support shaft 61*a* of the first pressing arm 61 independently of the rotation of the first pressing arm 61. The second pressure arm 62 is provided with a compression spring 64 that urges the first pressure arm 61 together with the pressure roller 57 toward the coating roller 52. One end of the compression spring 64 is connected to the first pressure arm 61 and the other end of the compression spring 64 is connected to the second pressure arm 62. A cam surface of the pressing cam 63 is in contact with an upper portion of the second pressing arm 62. The pressing cam 63 is rotated by the cam motor 71 to change the cam angle of the pressing cam 63, thus moving the pressure roller 57 up and down together with the first pressing arm 61 and the second pressing arm 62. When the coating step is performed, the pressure roller 57 is moved to a contact position illustrated in FIG. 6A, at which the pressure roller 57 contacts the coating roller 52, by the pressing mechanisms (including the first pressing arms 61, the second pressing arms 62, and the pressing cams 63). When the coating step is not performed, the pressure roller 57 is moved to a separated position (a position at which the pressure roller 57 is separated from the coating roller 52) by the pressing mechanisms (including the first pressing arms 61, the second pressing arms 62, and the pressing cams 63). Here, the coating apparatus 50 according to Variation 2 also includes a stopper 66 as a restrictor as in the present embodiment. Specifically, in Variation 2, as illustrated in FIGS. 6A and 6B, an opposite surface of the first pressing arm 61 (an opposite surface facing the second pressing arm 62) is provided with the stopper 66. When the sheet P enters the nip between the coating roller 52 and the pressure roller 57, the stopper 66 indirectly contacts the pressure roller 57 (contacts the second pressing arm 62) as illustrated in FIG. 6B and restricts, as the restrictor, the movement of the pressure roller 57 in the separating direction with respect to the coating roller 52. Such a configuration can reduce the uneven coating (variation) of the coating liquid G applied to the sheet P without causing the conveyance failure of the sheet P.

Variation 3

Figure 7:
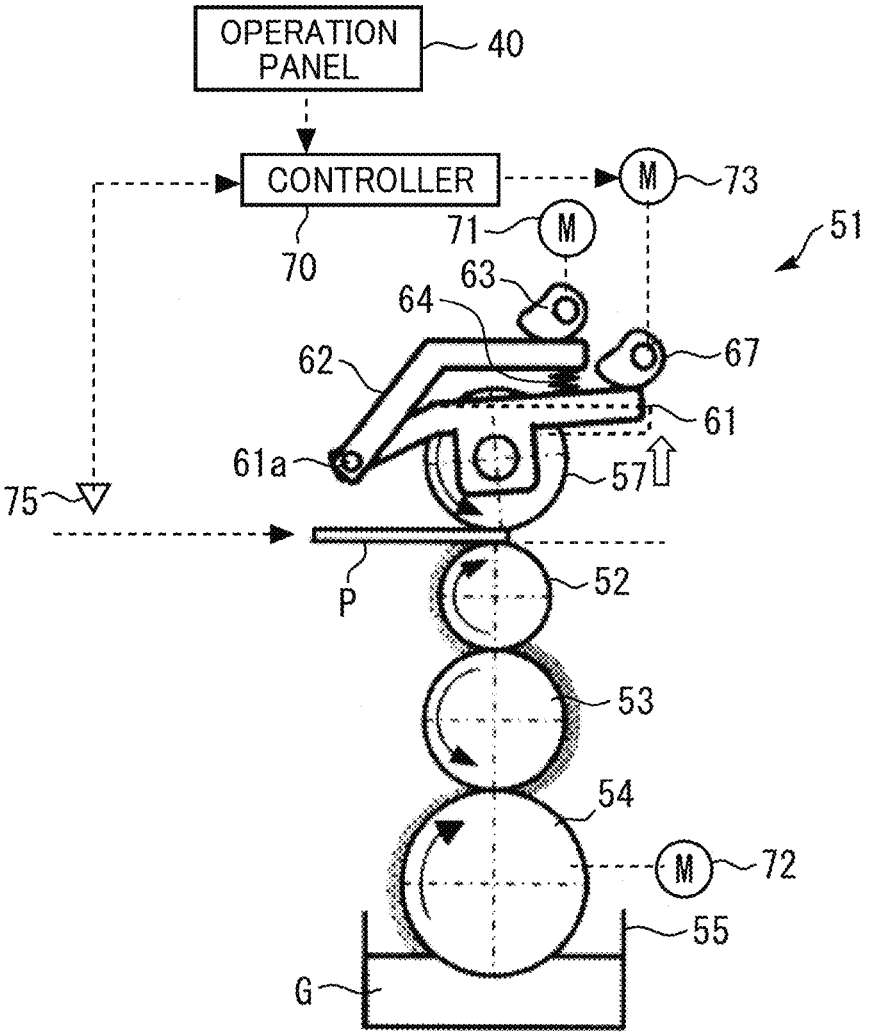
FIG. 7 is a schematic view of a part of a coating apparatus according to Variation 3.

FIG. 7 is a view of a main unit (coating-apparatus main unit 51) of a coating apparatus 50 as Variation 3 and is a view corresponding to FIG. 3B in the present embodiment. As illustrated in FIG. 7, each of the pressing mechanisms in Variation 3 includes, e.g., a first pressing arm 61, a second pressing arm 62, a pressing cam 63, and a compression spring 64, similarly with the pressing mechanism in Variation 2. In Variation 3, a cam 67 is used as the restrictor instead of the stopper 66 in Variation 2. The cam 67 as the restrictor is a cam capable of adjusting the movable distance of the pressure roller 57 in the separating direction (upward direction) according to the thickness of the sheet P entering the nip between the coating roller 52 and the pressure roller 57. Specifically, the cam 67 (restrictor) is provided such that a cam surface of the cam 67 can contact an upper portion of the first pressing arm 61, thus restricting the movement of the first pressing arm 61 in the separating direction (upward direction). A rotation shaft of the cam 67 (restrictor) is connected to a second cam motor 73. A controller 70 controls the second cam motor 73 to change the cam angle (posture in a direction of rotation of the cam 67). When the sheet P is not conveyed to the nip, there is a gap between the cam 67 and the first pressure arm 61 (located at a rotation position indicated by a broken line in FIG. 7). When the sheet P enters the nip and lifts the pressure roller 57 (first pressing arm 61) against the urging force of a compression spring 64 by the thickness of the sheet P, the cam 67 just contacts the first pressing arm 61 (the state illustrated in FIG. 7). Here, similarly with the cam 67 of Variation 1, the cam angle of the cam 67 in Variation 3 is also adjusted in accordance with the thickness of the sheet P entering the nip (a detection result of the sheet-thickness detection sensor 75 as the detector). Such a configuration can reduce the uneven coating (variation) of the coating liquid G applied to the sheet P without causing the conveyance failure of the sheet P regardless of the thickness of the sheet P.

Variation 4

Figure 8:
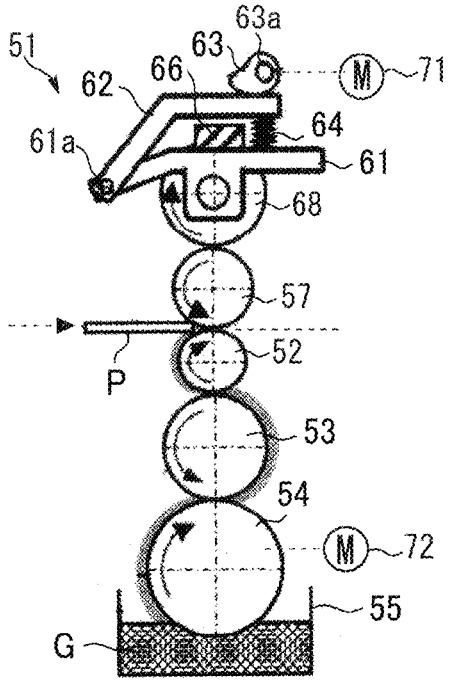
FIG. 8 is a schematic view of a part of a coating apparatus according to Variation 4.

FIG. 8 is a view of a main unit (coating-apparatus main unit 51) of a coating apparatus 50 as Variation 4 and is a view corresponding to FIG. 6A in Variation 2. As illustrated in FIGS. 8 to 10, the coating apparatus 50 according to Variation 4 is different from the coating apparatus 50 of Variation 2 illustrated in FIGS. 6A and 6B mainly in that the coating apparatus 50 according to Variation 4 includes a pressing roller 68 as a pressing member, first adjusting bolts 76 as gap adjusters, second adjusting bolts 77 as nip-pressure adjusters, and arm members 74 and tension springs 79 as pressure reducing mechanisms. As illustrated in FIGS. 8 to 11, the pressing roller 68 is held by the first pressing arm 61 (pressing arm) and functions as a pressing member that contacts the pressure roller 57 (pressure rotator). The first pressing arm 61 of the pressing mechanism (including the first pressing arm 61, the second pressing arm 62, the pressing cam 63, and the compression spring 64) urges the pressure roller 57 toward the coating roller 52 (coating rotator) via the pressing roller 68 (pressing member). Specifically, the pressing roller 68 is rotatably held by the first pressing arm 61 to follow the movement of the first pressing arm 61. The pressing roller 68 is formed such that the roller diameter of the pressing roller 68 is sufficiently larger than the roller diameter of the pressure roller 57 and the rigidity of the pressing roller 68 is sufficiently higher than the rigidity of the pressure roller 57. The pressing mechanism (including the first pressing arm 61, the second pressing arm 62, the pressing cam 63, and the compression spring 64) has substantially the same configuration as the pressing mechanism of FIGS. 6A and 6B described in Variation 2, except that the pressing mechanism of Variation 4 holds the pressing roller 68 instead of the pressure roller 57. Here, as illustrated in FIG. 10, the pressing mechanisms (including the first pressing arm 61, the second pressing arm 62, the pressing cam 63, and the compression spring 64) are installed at both end portions in the longitudinal direction (both end portions in the rotation axis direction) of the pressing roller 68. Accordingly, a central portion of the pressing roller 68 in the longitudinal direction is likely to be bent. However, since the roller diameter of the pressing roller 68 and the rigidity of the pressing roller 68 are increased, such bending is less likely to occur. Therefore, the pressing roller 68 is uniformly pressed against the pressure roller 57 in the longitudinal direction, thus reducing the uneven coating due to non-uniformity of the nip pressure between the pressure roller 57 and the coating roller 52 and also reducing the conveyance failure such as the skew of the sheet P.

Figure 9A:
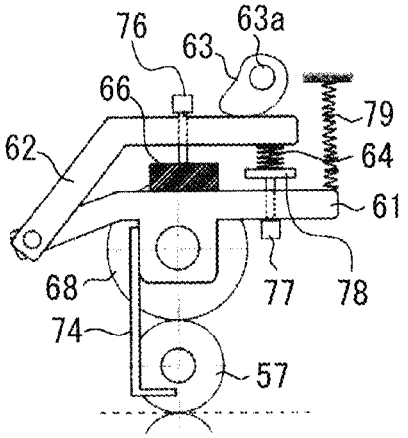
FIGS. 9A and 9B are enlarged views of a part of the coating apparatus of FIG. 8.
Figure 9B:
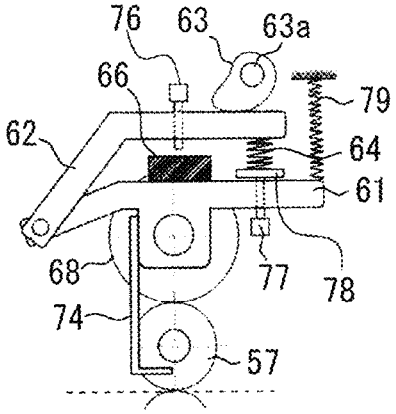
Figure 10:
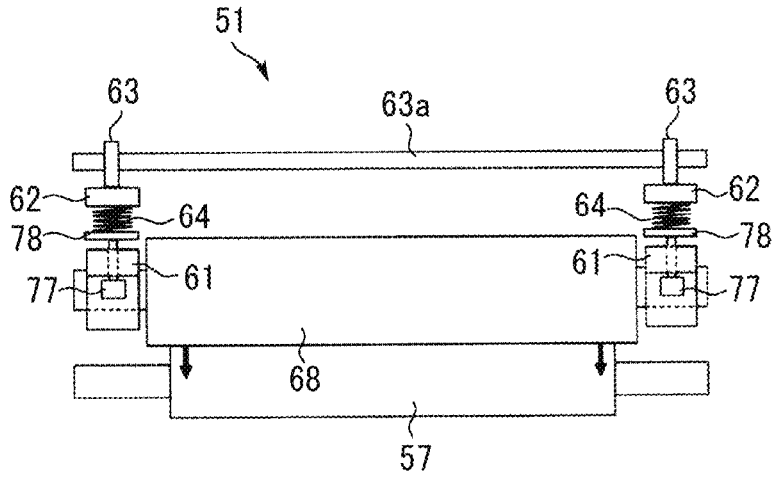
FIG. 10 is a schematic view of a part of the coating apparatus of FIG. 8 in a longitudinal direction of a pressing member.

Further, as illustrated in FIGS. 9A and 9B, first adjusting bolts 76 as gap adjusters are installed in the coating apparatus 50 according to Variation 4. The first adjusting bolt 76 functions as the gap adjuster to adjust a certain gap formed between the stopper 66 (restrictor) and the second pressing arm 62 (pressing arm) in a state where the sheet P does not enter the nip between the pressure roller 57 and the coating roller 52. Specifically, as illustrated in FIGS. 9A and 9B, the second pressing arm 62 includes a female screw portion at a position facing the stopper 66, and the first adjusting bolt 76 is screwed into the female screw portion. With such a configuration, as illustrated in FIGS. 9A and 9B, the tightening amount of the first adjusting bolt 76 is changed, thus allowing adjustment of the interval of the gap between a screw tip portion of the first adjusting bolt 76 and the stopper 66 (the gap between the second pressing arm 62 and the stopper 66). When the sheet P enters the nip, the stopper 66 contacts the second pressing arm 62, thus restricting the movement of the pressure roller 57 in the separating direction. However, since the gap between the stopper 66 and the second pressing arm 62 is formed in relation to a large number of components, variations in the component accuracy might be accumulated. Consequently, the gap between the stopper 66 and the second pressing arm 62 might not be set to a target value, thus hampering the stopper 66 from functioning as the restrictor. On the other hand, in Variation 4, the first adjusting bolts 76 as the gap adjusters are provided so that the gap between the stopper 66 and the second pressing arm 62 can be adjusted to a target value, thus preventing occurrence of such a failure.

Further, as illustrated in FIGS. 9A and 9B and FIG. 10, second adjusting bolts 77 as nip-pressure adjusting mechanisms are installed in the coating apparatus 50 according to Variation 4. The second adjusting bolts 77 as the nip-pressure adjusters adjust the pressure (nip pressure) of the nip between the pressure roller 57 and the coating roller 52. The second adjusting bolts 77 are arranged at positions separated in a longitudinal direction of the pressing roller 68 (a direction perpendicular to a surface of the drawing of FIG. 9A and a horizontal direction in FIG. 10). In Variation 4, as illustrated in FIG. 10, the second adjusting bolts 77 (nip-pressure adjusters) are provided at both ends of the pressing roller 68 in the longitudinal direction of the pressing roller 68. Specifically, as illustrated in FIGS. 9A and 9B and 10, a female screw portion is formed in the first pressing arm 61 at a position facing the compression spring 64, and the second adjusting bolt 77 is screwed into the female screw portion. Further, a receiving plate 78 is provided at a screw tip portion of the second adjusting bolt 77, and one end of the compression spring 64 is connected to the receiving plate 78. With such a configuration, as illustrated in FIGS. 9A and 9B, the tightening amount of the second adjusting bolt 77 is changed to change the use length of the compression spring 64, thus allowing adjustment of the nip pressure between the pressure roller 57 and the coating roller 52. The nip pressure between the pressure roller 57 and the coating roller 52 may have a deviation (pressure difference) in the longitudinal direction due to variations in component accuracy of related components. When the deviation of the nip pressure is caused as described above, the uneven coating in the longitudinal direction or the conveyance failure such as the skew of the sheet P may be caused. On the other hand, in Variation 4, since the second adjusting bolts 77 as the nip-pressure adjusters are provided at both end portions of the pressing roller 68 in the longitudinal direction so as to adjust the balance of the nip pressure between the pressure roller 57 and the coating roller 52 in the longitudinal direction, thus preventing the occurrence of such a failure. Further, the second adjusting bolts 77 as the nip-pressure adjusters can not only adjust the balance of the nip pressure in the longitudinal direction but also increase or decrease the entire nip pressure (total pressure), thus allowing adjustment of the entire coating amount of the coating liquid G.

Figure 11:
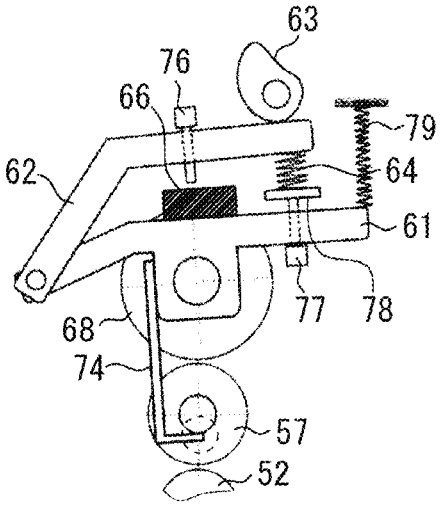
FIG. 11 is an enlarged view of a part of the coating apparatus of FIG. 8 for illustrating an operation.

Further, as illustrated in FIGS. 9A and 9B and 11, the arm member 74 and the tension spring 79 as a pressure reducing mechanism are installed in the coating apparatus 50 according to Variation 4. The arm member 74 and the tension spring 79 function as the pressure reducing mechanism that reduces the contact pressure (nip pressure) between the coating roller 52 (coating rotator) and the pressure roller 57 (pressure rotator) and reduces the contact pressure (nip pressure) between the pressure roller 57 and the pressing roller 68 (pressing member). Specifically, the L-shaped arm member 74 is secured to the first pressing arm 61. A portion (bent portion) of the arm member 74 bent in an L shape is positioned below a shaft portion of the pressure roller 57. One end of the tension spring 79 is connected to a distal end portion of the first pressing arm 61 away from the support shaft 61*a*. The opposite end of the tension spring 79 is connected to the main unit housing of the coating apparatus 50. As illustrated in FIGS. 9A and 9B, in a normal state, the bent portion of the arm member 74 is at a position away from the shaft portion of the pressure roller 57. In the normal state, the coating roller 52 and the pressure roller 57 contact each other at a target nip pressure, and the pressure roller 57 and the pressing roller 68 contact each other at a target nip pressure. By contrast, in reducing the nip pressure, as illustrated in FIG. 11, the pressing cam 63 is rotated by a predetermined angle about the cam shaft 63*a* by the driving of the cam motor 71, so that the second pressing arm 62 is rotated (lifted) counterclockwise about the support shaft 61*a*. Accordingly, the urging of the compression spring 64 is released, and the first pressing arm 61 is also rotated (lifted) counterclockwise about the support shaft 61*a*. Thus, the nip pressure between the pressure roller 57 and the pressing roller 68 is reduced. Further, the bent portion of the arm member 74 provided in the first pressing arm 61 pushes the shaft portion of the pressure roller 57 upward to move the pressure roller 57 moves upward, thus reducing the nip pressure between the coating roller 52 and the pressure roller 57. Such reduction of the nip pressure is performed to remove the sheet P when the sheet P is jammed (at the nip) between the pressure roller 57 and the coating roller 52. Such operation of the pressure reducing mechanism (including the arm member 74 and the tension spring 79) at the occurrence of a jam can be performed by controlling the driving of the cam motor 71 when the sheet detection sensor detects the jam of the sheet P. Providing the pressure reducing mechanism (including the arm member 74 and the tension spring 79) in this manner facilitates the work of removing a jammed sheet by the user. The nip pressure reduction by the pressure reducing mechanism including the arm member 74 and the tension spring 79 can be performed not only when a jam occurs but also when the sheet P is not interposed in the nip between the coating roller 68 and the pressure roller 57 during normal sheet passing. That is, when the sheet P passes through the nip, the nip pressure reduction is not performed as illustrated in FIGS. 9A and 9B. When the sheet P does not pass through the nip, the nip pressure reduction is performed as illustrated in FIG. 11. Accordingly, the pressure roller 57 and the coating roller 52 are in contact with each other for a long period of time, causing the coating liquid G to remain in the nip. Such a configuration can reduce a failure in which moisture evaporates from the coating liquid G to increase the viscosity and the increased viscosity of the coating liquid G may cause a jam of the sheet P or uneven coating. While the nip pressure is reduced by the pressure reducing mechanism (including the arm member 74 and the tension spring 79), the coating liquid G remaining in the nip is returned to the reservoir 55.

As described above, the coating apparatus 50 (of the image forming system 100) according to the present embodiment includes the coating roller 52 (coating rotator) that coats the sheet P with the coating liquid G and the pressure roller 57 (pressure roller) that forms a nip with the coating roller 52. The coating apparatus 50 further includes the stopper 66 (restrictor) to directly or indirectly contact the pressure roller 57 when the sheet P enters the nip between the coating roller 52 and the pressure roller 57, thus restricting the movement of the pressure roller 57 in the separating direction with respect to the coating roller 52. Such a configuration can prevent variations in the amount of the coating liquid G applied to the sheet P.

In the present embodiment, the coating apparatus 50 is described as the pre-treatment apparatus of the image forming apparatus 1 illustrated as an inkjet printer. However, the pre-treatment apparatus is not limited to the coating apparatus 50 and may be any coating apparatus that coats a coating liquid to a sheet. In the present embodiment, the coating roller 52 is used as the coating rotator, and the pressure roller 57 is used as the pressure rotator. However, the coating rotator and the pressure rotator are not limited to the coating roller 52 and the pressure roller 57, respectively. For example, a coating belt (belt member) supported by a plurality of rollers may be used as the coating rotator, or a pressure belt (belt member) supported by a plurality of rollers may be used as the pressure rotator. In the present embodiment, the positional relationship between the coating roller 52 and the pressure roller 57 in the coating apparatus 50 is illustrated in FIG. 1. However, in some embodiments, for example, the coating roller 52 and the pressure roller 57 may be exchanged. Such a configuration can also exert effects similar to the above-described effects of the present embodiment.

Note that embodiments of the present disclosure are not limited to the above-described embodiments and it is apparent that the above-described embodiments can be appropriately modified within the scope of the technical idea of the present disclosure in addition to what is suggested in the above-described embodiments. Further, the number, position, shape, and so on of components are not limited to those of the present embodiment, and may be the number, position, shape, and so on that are suitable for implementing the present invention.

In the present specification, the term "sheet" is not limited to sheet of paper, and is defined to include all sheet-shaped recording media, such as coated paper, label paper, OHP sheets, and metal sheets.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A coating apparatus comprising:

a coating rotator configured to coat a sheet with a coating liquid;

a pressure rotator configured to form a nip between the coating rotator and the pressure rotator; and a restrictor configured to directly or indirectly contact the pressure rotator when the sheet enters the nip, and restrict movement of the pressure rotator in a separating direction with respect to the coating rotator.

2. The coating apparatus according to claim 1, wherein the restrictor does not directly or indirectly contact the pressure rotator in a state in which the sheet is not in the nip.

3. The coating apparatus according to claim 1, further comprising a pressing arm configured to urge the pressure rotator toward the coating rotator, wherein the restrictor contacts the pressing arm when the sheet enters the nip, and restrict the movement of the pressure rotator in the separating direction.

4. The coating apparatus according to claim 3, further comprising a pressing member held by the pressing arm and configured to contact the pressure rotator, wherein the pressing arm urges the pressure rotator toward the coating rotator via the pressing member.

5. The coating apparatus according to claim 4, further comprising a pressure reducing mechanism configured to reduce a contact pressure between the coating rotator and the pressure rotator and reduce a contact pressure between the pressure rotator and the pressing member.

6. The coating apparatus according to claim 3,
wherein the restrictor is separated with a gap from the pressing arm in a state in which the sheet is not in the nip.

7. The coating apparatus according to claim 6, further comprising a gap adjuster configured to adjust the gap.

8. The coating apparatus according to claim 1,
wherein a plurality of nip-pressure adjusters at positions separated in a longitudinal direction of the coating apparatus, to adjust a pressure of the nip.

9. The coating apparatus according to claim 1,
wherein the restrictor is formed of an elastic material.

10. The coating apparatus according to claim 9,
wherein the elastic material is a rubber material having a Shore A hardness in a range of 30 to 70.

11. The coating apparatus according to claim 1,
wherein the restrictor is an adjustment mechanism configured to adjust a movable distance of the pressure rotator in the separating direction in accordance with a thickness of the sheet entering the nip.

12. The coating apparatus according to claim 11, further comprising a detector configured to directly or indirectly detect a thickness of the sheet entering the nip,
wherein the adjustment mechanism increases the movable distance of the pressure rotator in the separating direction as the thickness of the sheet detected by the detector is thicker.

13. An image forming system comprising:
the coating apparatus according to claim 1; and
an image forming apparatus.

* * * * *